US012305477B2

(12) United States Patent
Lo et al.

(10) Patent No.: US 12,305,477 B2
(45) Date of Patent: May 20, 2025

(54) METHODS AND SYSTEMS FOR A FRAC PLUG

(71) Applicant: Vertice Oil Tools, Inc., Stafford, TX (US)

(72) Inventors: Mike Lo, Houston, TX (US); Mohamed Saraya, Sugar Land, TX (US)

(73) Assignee: Vertice Oil Tools Inc., Missouri City, TX (US)

( * ) Notice: Subject to any disclaimer, the term of this patent is extended or adjusted under 35 U.S.C. 154(b) by 0 days.

(21) Appl. No.: 18/129,459

(22) Filed: Mar. 31, 2023

(65) Prior Publication Data

US 2023/0250704 A1 Aug. 10, 2023

Related U.S. Application Data

(63) Continuation of application No. PCT/US2021/056567, filed on Oct. 26, 2021.

(60) Provisional application No. 63/107,974, filed on Oct. 30, 2020.

(51) Int. Cl.

| | |
|---|---|
| ***E21B 33/128*** | (2006.01) |
| ***E21B 33/129*** | (2006.01) |
| ***E21B 33/134*** | (2006.01) |
| ***E21B 43/26*** | (2006.01) |

(52) U.S. Cl.

CPC ..... *E21B 33/134* (2013.01); *E21B 43/26* (2013.01)

(58) Field of Classification Search

CPC ..... E21B 33/1292; E21B 33/134; E21B 2200/05; E21B 17/06; E21B 17/042; E21B 33/1293

See application file for complete search history.

(56) References Cited

U.S. PATENT DOCUMENTS

| | | | | | |
|---|---|---|---|---|---|
| 2,823,754 | A * | 2/1958 | Ault | E21B 33/1295 | 166/212 |
| 3,082,824 | A * | 3/1963 | Taylor | E21B 33/1293 | 166/134 |
| 3,136,365 | A | 6/1964 | Carter et al. | | |
| 3,358,766 | A * | 12/1967 | Current | E21B 33/1216 | 166/134 |
| 4,730,835 | A * | 3/1988 | Wilcox | E21B 33/1216 | 166/134 |
| 4,862,967 | A * | 9/1989 | Harris | E21B 33/1208 | 166/387 |
| 4,934,459 | A * | 6/1990 | Baugh | E21B 33/1293 | 166/380 |
| 5,467,819 | A * | 11/1995 | Braddick | E21B 23/06 | 166/117.6 |
| 5,819,846 | A * | 10/1998 | Bolt, Jr. | E21B 33/134 | 166/123 |
| 6,354,372 | B1 * | 3/2002 | Carisella | E21B 33/1216 | 166/134 |

(Continued)

OTHER PUBLICATIONS

Outgoing Written Opinion of the International Searching Authority (ISA), PCT/US21/56567, published Jan. 26, 2022.

*Primary Examiner* — Kenneth L Thompson
(74) *Attorney, Agent, or Firm* — Pierson IP, PLLC

(57) ABSTRACT

Utilizing threads and coupling mechanisms to selectively secure slips and cones directly to a mandrel, wherein a distal end of the lower slips includes projections configured to interface with depressions within a cap of the frac plug to limit the relative rotation of the slips.

6 Claims, 6 Drawing Sheets

(56) References Cited

U.S. PATENT DOCUMENTS

| | | | | |
|---|---|---|---|---|
| 7,455,118 | B2 * | 11/2008 | Roberts | E21B 23/06 166/134 |
| 7,510,018 | B2 * | 3/2009 | Williamson | E21B 33/1295 166/387 |
| 8,579,023 | B1 * | 11/2013 | Nish | E21B 33/128 166/134 |
| 8,770,276 | B1 | 7/2014 | Nish et al. | |
| 10,961,811 | B2 * | 3/2021 | Zeng | E21B 33/134 |
| 11,193,347 | B2 * | 12/2021 | Smith | E21B 23/01 |
| 11,459,850 | B2 * | 10/2022 | Power | E21B 33/128 |
| 11,661,814 | B1 * | 5/2023 | Saraya | E21B 23/01 166/387 |
| 11,982,151 | B2 * | 5/2024 | Schnell | E21B 33/134 |
| 2007/0102165 | A1 | 5/2007 | Slup et al. | |
| 2008/0190600 | A1 | 8/2008 | Shkurti et al. | |
| 2013/0341049 | A1 | 12/2013 | Roberts | |
| 2016/0194932 | A1 | 7/2016 | Liu | |
| 2019/0153807 | A1 * | 5/2019 | Barlow | E21B 33/128 |
| 2020/0256157 | A1 | 8/2020 | Saraya | |

* cited by examiner

METHODS AND SYSTEMS FOR A FRAC PLUG

BACKGROUND INFORMATION

Field of the Disclosure

Examples of the present disclosure relate to Frac Plugs with a flapper, wherein the frac plugs utilize threads and coupling mechanisms to selectively secure slips and cones directly to a mandrel. Additionally, a distal end of the lower slips includes projections configured to interface with depressions within a cap of the frac plug to limit the relative rotation of the slips.

Background

Conventionally, after cementing a well and to achieve Frac/zonal isolation for a Frac operation, a frac plug and perforations on a wireline are pushed downhole to a desired a depth. Then, a frac plug is set and perforation guns are fired above to create conduit to frac fluid. This enables the fracing fluid to be pumped. Typically, to aid in allowing the assembly of perforation and frac plug to reach the desired depth, specifically in horizontal or deviated laterals, pumping operation can be used. During the pumping operation the wireline is pumped down hole with the aid of flowing fluid.

These conventional frac plugs are held in place via slips and packing elements. Conventional slips, cones, and packing elements are loaded on an outer mandrel on the frac plug. A cap is then secured on a distal end of the frac plug, and the cap is threaded or held in place via pins or other methods. This means that the elements of the frac plug between a load ring and the cap are free floating.

However, to position frac plugs at a desired depth, fluid is required to be pumped around the frac plug as a result of pumping the wireline down hole. When fluid is pumped downhole, pressure/forces acting upon the elements and the cones of the frac plug changes, which can cause movement or swabbing of the elements of the frac plug. This movement of the elements can cause the slips to prematurely be loaded and deployed in what is usually referred to as " pre-mature setting".

Accordingly, needs exist for systems and methods utilizing a frac plug, wherein the slips and cones are secured in place to the mandrel of the frac plug via breakable threads and screws. In embodiments, the breakable threads are configured to limit the linear movement of the elements of the frac plug.

SUMMARY

Embodiments disclosed herein describe systems and methods for a frac plug. The frac plug may include a load ring, upper slips, upper cone, packing element, lower cone, lower slips, and cap, which may be sequentially loaded on a mandrel of the frac plug.

The load ring may be an upper bound of the elements of positioned on the outer diameter of the mandrel. The load ring may operate as a no-go, stopper, etc. configured to limit the movement of the other elements on the outer mandrel towards a proximal end of the frac plug, wherein the proximal end of the frac plug is positioned closer to a surface of the wellbore than a distal end of the frac plug. In other embodiments, the load ring may also be used to transfer forces from the setting tool to the Frac Plug components such that the slips can engage the casing ID and plug can be set in place.

The upper slips may be positioned adjacent to the load ring. The upper slips may be configured to radially expand/break based on the movement of the load ring and upper cone. In embodiments, the term slip may refer to an individual element forming a slip comprised of a plurality of slips.

The upper cone may be positioned between the upper slips and the packing element. The upper cone may be configured to engage with the upper slips to radially expand/break the upper slips. In embodiments, the upper cone may be coupled to the mandrel via breakable threads or any other breakable coupling mechanism. The threads on the upper cone may be configured to directly couple the upper cone with the mandrel of the frac plug to maintain the upper cone in a non-deployed state even with incidental movement from the packing element.

The packing element may be a packer/rubber/elastic material that is configured to compress and radially expand across the wellbore. The packer may be configured to compress based on a pressure differential/forces across the packer caused by the upper cone and the lower cone trapping these pressures/forces during frac plug setting and/or while fracing operation above the frac plug after setting.

The lower cone may be positioned between the packing element and the lower slips. The lower cone may be configured to engage with the lower slips to radially expand or break the lower slips. In embodiments, the lower cone may be coupled to the mandrel via breakable threads or any other breakable coupling mechanism. The threads on the lower cone may be configured to directly couple the lower cone with the mandrel of the frac plug to maintain the lower cone in a non-deployed state even with incidental movement from the lower slips or packing element.

The lower slips may be positioned adjacent to the lower cone and cap. The lower slips may be configured to radially expand or break based on the movement of the lower cone. In embodiments, the lower slips may be coupled to the mandrel via breakable threads or any other breakable coupling mechanism,. The threads on the lower slips may be configured to directly couple the lower slips with the mandrel of the frac plug to maintain the lower slips in a non-deployed state even with incidental movement from the lower cone.

The cap may be positioned on a distal end of the frac plug. The cap includes a passageway, recess, and projection. The passageway may be an opening extending through the inner diameter of the cap from a proximal end to a distal end of the cap, which allows fluid to flow through the inner diameter of the frac plug. The recess may a groove, depression, etc. be positioned on the distal end of the cap, wherein the recess is cylindrical in shape. The projection may extend away from the lip in a direction along the longitudinal axis of the frac plug. The projection may have an inner diameter that is greater than that of the passageway and smaller than an outer diameter of the recess. The projection may be configured to receive a frac ball, object, etc., such that if the frac ball is positioned on the projection there is communication through passageway via the space between the frac ball and the recess.

In embodiments, the cap and the lower slips may form an anti-rotation mechanism. The anti-rotation mechanism may be configured to allow relative linear movement between the cap and the lower slips but restrict relative rotational movement between the cap and the groove. The anti-rotation mechanism may include projections positioned on a distal end of the lower slips and grooves positioned on a proximal end of the cap. In alternative embodiments, the projections may be positioned on a proximal end of the cap, and the grooves may be positioned on the distal end of the lower slips.

Embodiments may include a projection on the lower cone that is configured to be inserted into a groove on the lower slips, wherein a width of projection is substantially similar to that of the groove. The projection on the lower cone may have planar sidewalls that extend in an angle that extends in a first plane in parallel to each other. The planar sidewalls may also extend in an angle orthogonal to a central axis of the downhole tool. The groove on the lower slips may include planar sidewalls that extend in an angle in parallel to the first plane, wherein a width of the planer sidewalls is substantially the same as those of sidewalls. As such, the planar sidewalls are oriented at the same angle relative to each other. The groove may include a triangular shape, "v-shaped," etc. opening with sidewalls that extend in the first plane. The triangular shape opening may gradually narrow the size of the groove, which the planar sidewalls of groove remain extending in the first plane.

Embodiments may include a flapper with a weak point, wherein the flapper is configured to rotate from a position blocking an inner diameter of the frac plug to a position allowing fluid to flow around the flapper. The flapper may be mounted inside the mandrel of the frac plug. The flapper may include a removable weak point assembly that is configured to form a passageway responsive to removing the removable weak point assembly, wherein the weak point assembly extends from an upper surface of the flapper to a lower surface of the flapper.

These, and other, aspects of the invention will be better appreciated and understood when considered in conjunction with the following description and the accompanying drawings. The following description, while indicating various embodiments of the invention and numerous specific details thereof, is given by way of illustration and not of limitation. Many substitutions, modifications, additions or rearrangements may be made within the scope of the invention, and the invention includes all such substitutions, modifications, additions or rearrangements.

BRIEF DESCRIPTION OF THE DRAWINGS

Non-limiting and non-exhaustive embodiments of the present invention are described with reference to the following figures, wherein like reference numerals refer to like parts throughout the various views unless otherwise specified.

Figure 1:
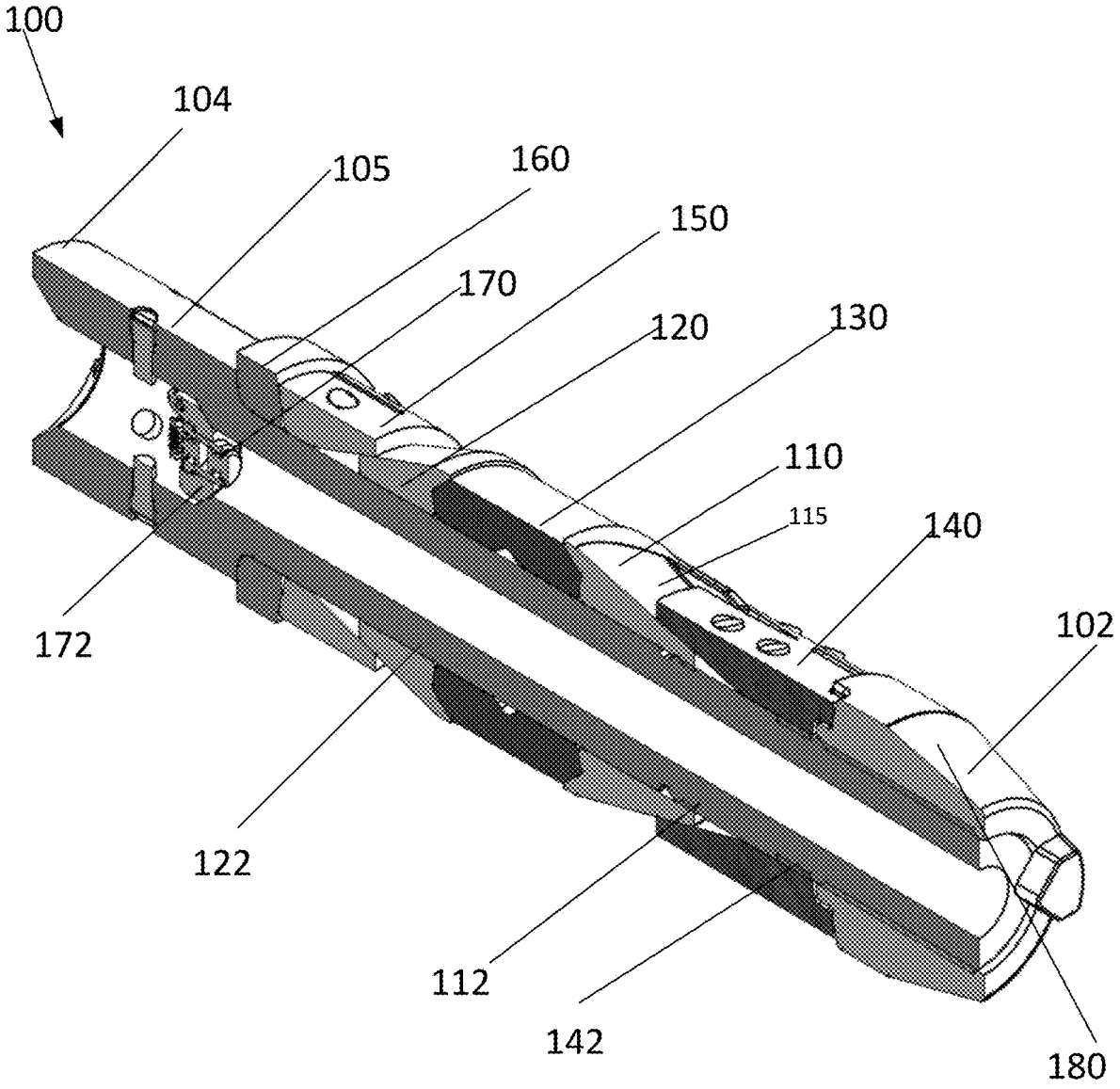
FIG. 1 depicts a downhole tool, according to an embodiment.

Corresponding reference characters indicate corresponding components throughout the several views of the drawings. Skilled artisans will appreciate that elements in the figures are illustrated for simplicity and clarity and have not necessarily been drawn to scale. For example, the dimensions of some of the elements in the figures may be exaggerated relative to other elements to help improve understanding of various embodiments of the present disclosure. Also, common but well-understood elements that are useful or necessary in a commercially feasible embodiment are often not depicted in order to facilitate a less obstructed view of these various embodiments of the present disclosure.

DETAILED DESCRIPTION

In the following description, numerous specific details are set forth in order to provide a thorough understanding of the present invention. It will be apparent, however, to one having ordinary skill in the art that the specific detail need not be employed to practice the present invention. In other instances, well-known materials or methods have not been described in detail in order to avoid obscuring the present invention.

FIG. 1 depicts a downhole tool 100, according to an embodiment. Downhole tool 100 may be a frac plug, which may be configured to isolate a stage in a cased hole after cementing. Downhole tool 100 may enable perforating and treating each stage optimally and selectively, wherein downhole tool 100 is pumped down to a desired depth, set, the zone above may be perforated. Downhole tool 100 may include a mandrel 105, lower cone 110, upper cone 120, packing element 130, lower slips 140, upper slips 150, load ring 160, flapper 172, and cap 180.

Lower cone 110 may be positioned between packing element 130 and lower slips 140. Lower cone 110 may be configured to engage with lower slips 140 to radially expand or break the lower slips 140. In embodiments, lower cone 110 may be coupled to the mandrel 105 via threads 112 or other any other coupling method. Threads 112 may be positioned on an outer circumference of mandrel 105, and may allow lower cone 110 to be coupled to mandrel 105. The coupling of lower cone 110 and mandrel 105 may limit the longitudinal movement of lower cone 110 while downhole tool 100 is being run in hole. Specifically, threads 112 may not allow lower cone 110 to move to interface with lower slips 140 prematurely before an operation is used to activate downhole tool 100. As such, incidental pressure changes from fluid flowing around lower cone 110 while downhole tool 100 is being pumped downhole may not be sufficient to substantially move lower cone 110 to set lower slips 140. Responsive to performing an operation to set downhole tool 100, such as operating a setting tool, the forces applied against threads 112 may be sufficient enough to break the threads, which may allow lower cone 110 to move. As such, threads 112 may be breakable threads, which after being broken allow for the longitudinal movement of lower cone 110. In embodiments, threads 112 may be broken to performing an operation to set downhole tool 100.

Upper cone 120 may be positioned between the upper slips 150 and packing element 130. Upper cone 120 may be configured to engage with upper slips 150. When upper cone 120 engages with upper slips 150, upper slips 150 may radially expand. In embodiments, the upper cone may be coupled to the mandrel 105 via threads 122. Threads 122 may allow upper cone 120 to be coupled to mandrel 105, which may limit the longitudinal movement of upper cone 120 while downhole tool 100 is being run in hole. Specifically, threads 122 may not allow upper cone 120 to move to interface with upper slips 150 or packing element 130 prematurely before an operation is used to activate downhole tool 100. As such, incidental pressure changes from fluid flowing around upper cone 120 while downhole tool 100 is being pumped downhole may not be sufficient to substantially move upper cone 120 to set upper slips 120. Responsive to performing an operation to set downhole tool 100, such as operating the setting tool, the forces applied against threads 122 may be sufficient enough to break the threads, which may allow upper cone 120 to move.

Packing element 130 may be a hydraulic packer that is configured to radially expand and seal across the annulus based on a pressure differential. An elasticity of Packing element 130 may be based upon the cross sectional thickness of sealing element, which may be controlled based on the profiles of the inner diameter and outer diameter of Packing element 130. Outer diameter of Packing element 130 may have a concave curvature, which increases a thickness of sealing element 150 towards the ends of the longitudinal axis of Packing element 130. By varying the thickness of the Packing element 130, cross-sectional areas of the Packing element 130 may be varied. This may change a pressure differential applied to the Packing element 130 at different cross sectional areas. Accordingly, as fluid is pumped within the annulus between the outer surface of the packer and casing, the curvature of the outer surface may control or create a Bernoulli Effect and the pressure differential across the Packing element 130 at different locations. As such, packing element 130 may not deploy prematurely. In embodiments, packing element 130 may be positioned between lower cone 110 and upper cone 120, and may be configured to radially expand responsive to a distance between lower cone 110 and upper cone 120 decreasing, which may occur after threads 112 and 122 are broken.

Lower slips 140 and upper slips 150 may be configured to radially move outward across an annulus to secure mandrel 105 to a casing, wherein an annulus is positioned between an outer diameter of mandrel 105 and the casing. Responsive to moving slips 140, 150 across the annulus, slips 140, 150 may grip the inner diameter of the casing.

Lower slips 140 may be positioned between lower cone 110 and cap 180. Lower slips 140 may be configured to radially expand or break responsive to ramp 115 and lower cone 110 moving towards lower slips 140. Lower slips 140 may include threads 142 may allow lower slips 140 to be coupled to mandrel 105, which may limit the longitudinal movement of lower slips 140 while downhole tool 100 is being run in hole. Specifically, threads 132 may not allow lower slips 140 to move prematurely before an operation is used to activate downhole tool 100. Responsive to performing an operation to set downhole tool 100, such as operating the setting tool, the forces applied against threads 142 may be sufficient enough to break the threads, which may allow lower slips 140 to move. In embodiments, threads 142 may be located at a position that is not overlapped with a distal end of lower cone 110. In embodiments, threads 112, 122, 142 may be a same sized—non binding threads that are configured to break at the same pressure differential, or different sized threads that break at different pressure differentials. In other embodiments, the lower slips 140 may expand radially as it moves relative to the lower cone, allowing the lower slips to engage the casing before the thread break due to lower slip's 130 internal diameter becoming bigger as it radially expands.

Upper slips 150 may be positioned between upper cone 120 and load ring 160. Upper slips 150 may be configured to radially expand responsive to upper cone 120 moving below upper slips 150. Responsive to performing an operation to set downhole tool 100, such as operating the setting tool, the forces applied may allow upper cone 120 to move, and subsequently move upper slips 150.

Load ring 160 may be an upper bound of the elements of positioned on the outer diameter of the mandrel 105. Load ring 160 may operate as a no-go, stopper, etc. configured to limit the movement, towards a proximal end of the frac plug, of the other elements on the outer mandrel 105. Load ring may be also used to transfer the force from the setting tool during operation to the other components of the frac plug, allowing frac plug to engage the casing ID and set inside.

Cap 180 may be positioned on a distal end 102 of downhole tool. Cap 180 may be positioned adjacent to lower slips 140, and limit the rotational movement and linear movement of lower slips 140. Cap may include a passageway that extends through the inner diameter of the cap from a proximal end to a distal end of the cap 180. The passageway may allow fluid to flow through the inner diameter of the frac plug.

Flapper 172 may be configured to allow the flow of fluid in one direction. The one direction may usually from distal end of the well to the proximal end of the well, while restricting the flow of fluid in the opposite direction. Flapper 172 may be made of millable material such as plastic, fiber, brass or dissolvable material. In further embodiments, Flapper 172 may be configured to have an open and closed positioned responsive to flowing fluid from a distal end of tool 100 towards a proximal end of tool 100 while the weak point assembly 170 is intact. In embodiments, flapper 172 may be mounted across an inner diameter of downhole tool 100 or on mandrel 105. Flapper 172 may include weak point assembly 170 , wherein weak point assembly 170 may be configured to assist in controlling the flow of fluid between a positioned above flapper 172 and a location below flapper 172. Weak point assembly 170 may include a housing, disc, and shear pin or shear disc, wherein weak point assembly 170 may be any geometric shape. The housing may be configured to be positioned within a passageway in weak point assembly 170. The housing may be a removable component within weak point assembly or may be an integral component. The housing may have a hollow inner diameter extending from a first face of housing to a second face of housing. In embodiments, fluid may be configured to flow through the hollow inner diameter responsive to a disc being removed from the housing. The housing may be configured to temporarily secure the disc and shear pin. The disc may be an object that is configured to be embedded within the housing when weak point assembly 170 is intact. The disc may be configured to move downhole etc. responsive to a pressure differential applied to a shear pin being greater than a pressure threshold. The shear pin may be a device be inserted into the housing and extend through and across the disc. In embodiments, the shear pin may be exposed to shearing forces via pressure applied on the disc, wherein when the shearing forces are greater than a pressure rating of the shear pin then the shear pin may break. Responsive to the breaking, the disc may move from a positioned within the housing to a position outside of the housing.

In embodiments, weak point assembly 170 may be used in a fracturing procedure utilizing fracturing fluid that fractures formation after the well is cemented. In embodiments, a fracturing procedure may be any procedure associated a well after it is cemented and before the well is abandoned, such as a gun misfire, premature setting of the frac plug, formation screen out above the plug, or any other operation that utilize a frac plug that may include or cause increase in the pressure above the weak point value within the frac plug if needed.

Figure 2:
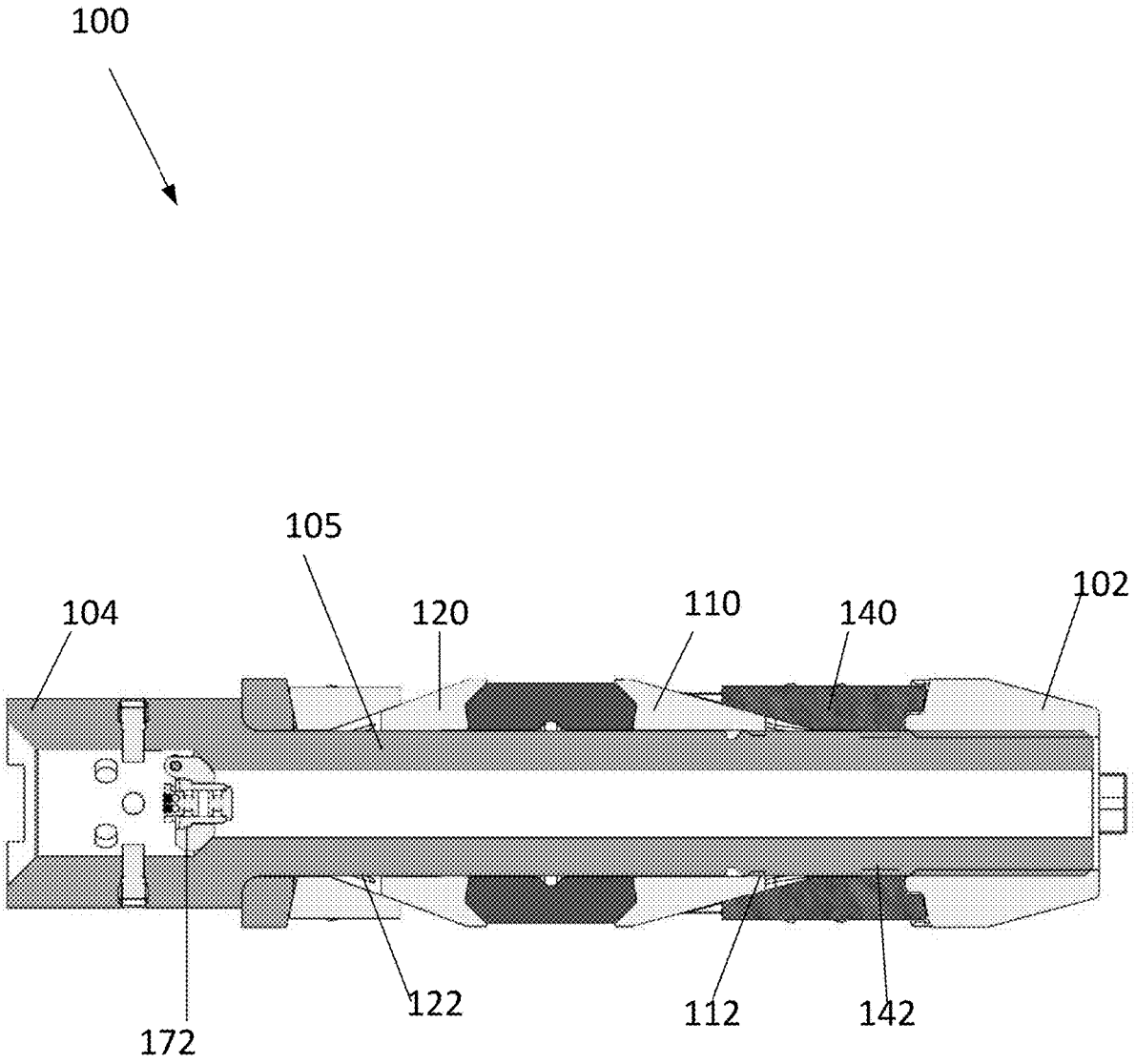
FIG. 2 depicts lower slips of a downhole tool, according to an embodiment.

As depicted in FIG. 2, lower slips 110 may be positioned closer to a distal end 102 of downhole tool 100 than upper slips 120. Upper slips 120 may be positioned closer to a proximal end 104 of downhole 100 than lower slips 130.

Furthermore, FIG. 2 depicts the relative positioning on threads 112, 122, 142, which allow the corresponding elements to be coupled to mandrel 105.

Figure 3:
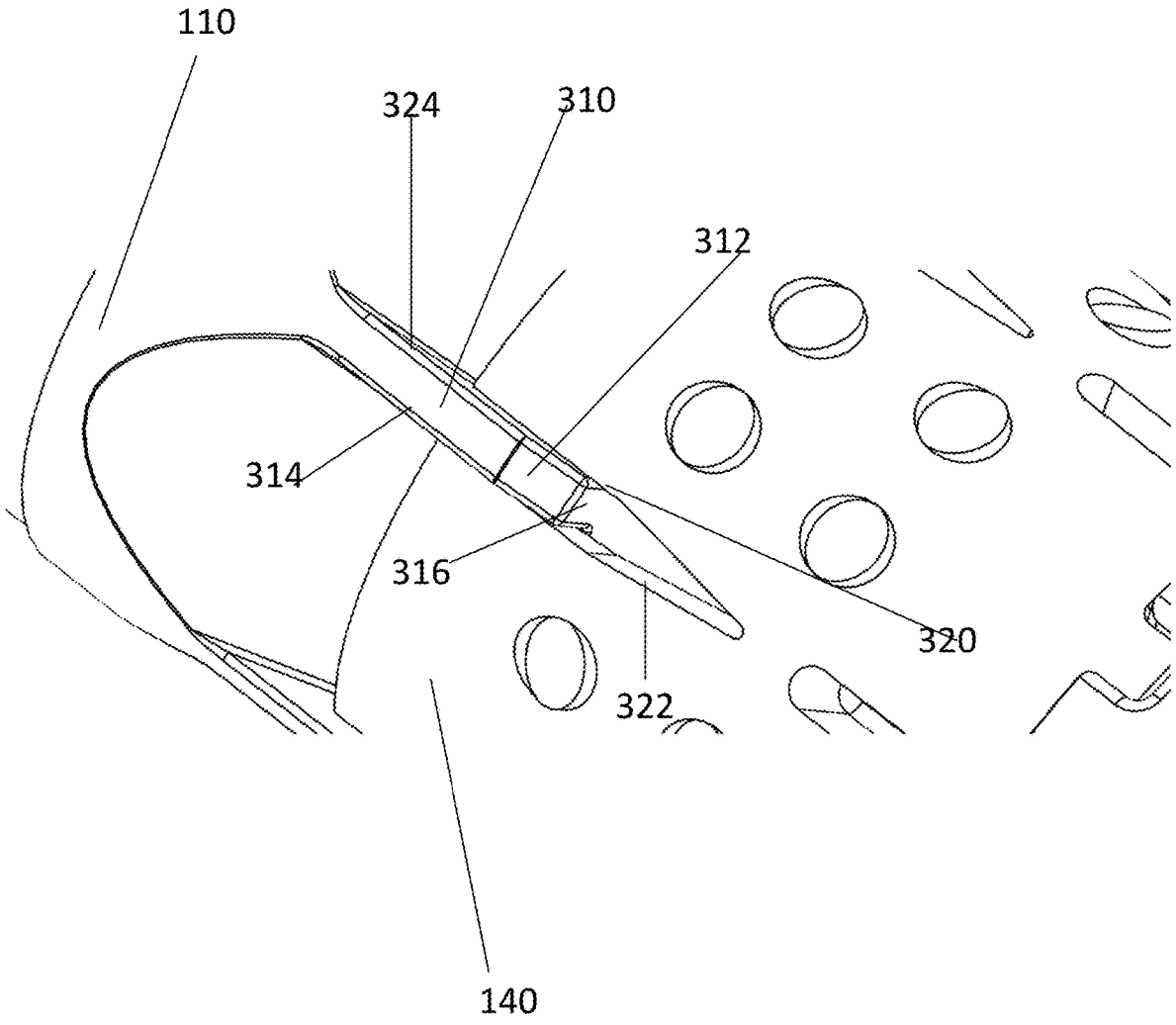
FIG. 3 depicts lower slips and a lower cone of a downhole tool, according to an embodiment.

FIG. 3 depicts a detailed view of lower cone 110 and lower slips 120. Elements described in FIG. 3 may be described above, and for the sake of brevity a further description of these elements is omitted.

Lower cone 110 may include a projection 310, or fin, that is configured to be inserted into a groove 320 of lower slips 120, wherein a width of projection 310 is substantially similar but not bigger to that of groove 320.

Projection 310 may have planar sidewalls 314 that extend in an angle that extends in a first plane in parallel to each other, and orthogonal to a central axis of downhole tool 100. Projection 310 may also include a tapered distal end 312, which gradually decreases a height of projection 310, while the width of projection 310 remains constant. Distal end 312 may end in a planar sidewall 316 that extends in the first plane extending towards the central axis of downhole tool.

Lower slips 120 may be a one piece slips, and with grooves 320. Groove 320 may include planar sidewalls 324 that extend in an angle in parallel to the first plane, wherein a width of sidewalls 324 is substantially the same as those of sidewalls 314. As such, sidewalls 324 are oriented at the same angle relative to each other as sidewalls 314. Groove 320 may include a triangular shape, "v-shaped," etc. opening 324 with sidewalls that extend in the first plane. The triangular shape opening 324 may gradually narrow the size of groove 320, which the sidewalls 322 of groove remain extending in the first plane.

Figure 4:
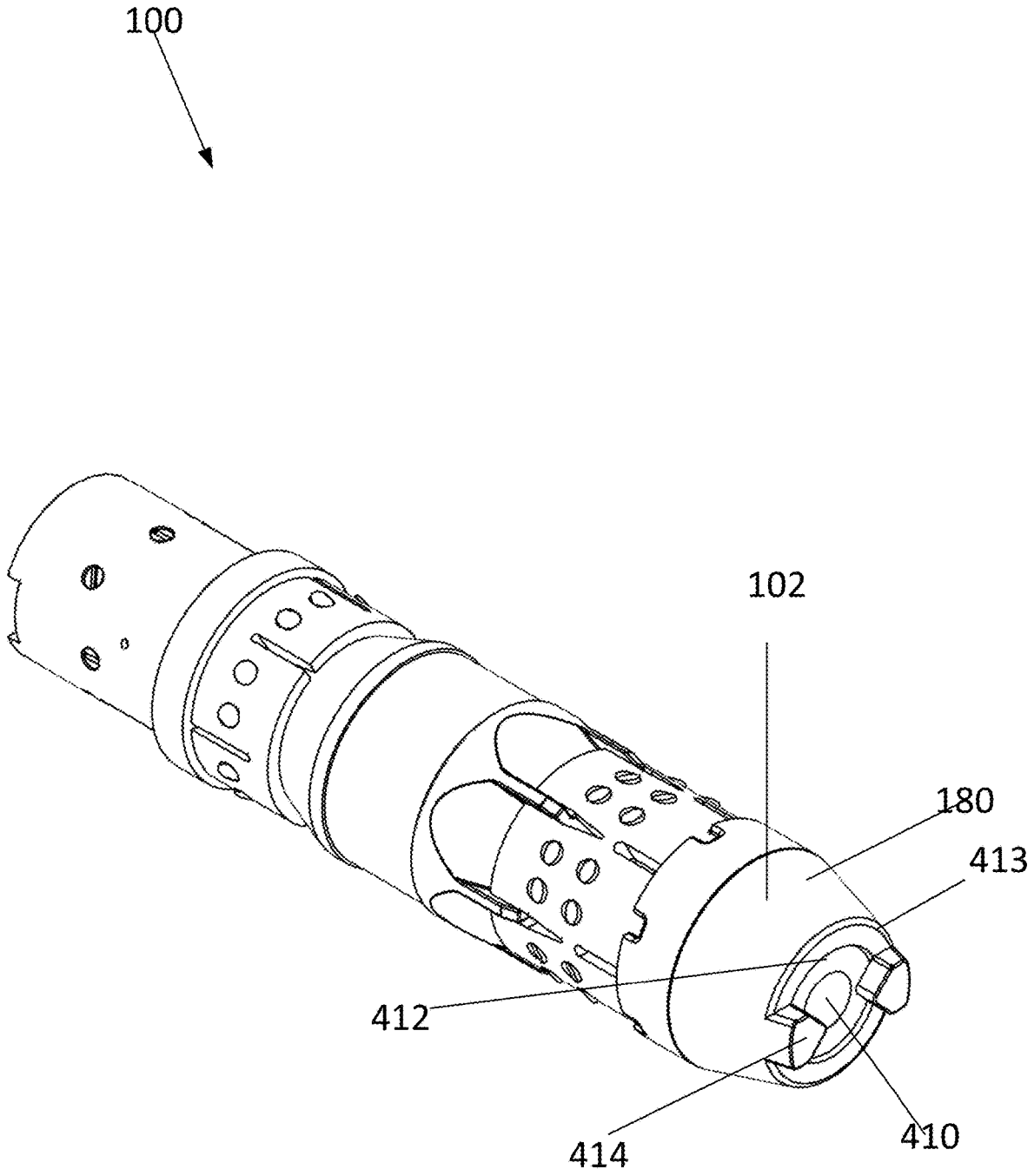
FIG. 4 depicts a distal end of downhole tool, according to an embodiment.

FIG. 4 depicts distal end 102 of downhole tool 100, according to an embodiment. Elements depicted in FIG. 4 may be described above, and for the sake of brevity a further description of these elements is omitted.

As depicted in FIG. 4, cap 180 may be positioned on a distal end 102 downhole tool 100. On the distal most end of cap 180, may be a passageway, 410, recess 412, and projection 414.

Passageway 410 may be an opening extending through the inner diameter of cap 180 from a proximal end to a distal most end of cap 180, which allows fluid to flow through the inner diameter of the frac plug. In embodiments, passageway 410 may have a first diameter.

Recess 412 may a groove, depression, etc. be positioned on the distal end of the cap 180, wherein recess 412 is cylindrical, washer shaped. Recess 412 may have an outer diameter, which is larger in size than the first diameter. The recess may allow for a step down between an outer surface of cap 180, and the lower surface of recess.

Projection 414 may extend away from recess 412 in a direction along the longitudinal axis of the downhole tool 100. Projection 414 may have an inner diameter that is smaller than an outer diameter of the recess 412. Therefore, the projection may extend from outer surface 413 towards passageway 410, but being overlaid on portions of recess 412. Projection 414 may be configured to receive a frac ball, object flowing up the well, etc., such that if the frac ball is positioned on Projection 414 there is communication through passageway 410 via the space between the frac ball and recess 412 created by the offset surface of projection 414. As such, projection 414 may be utilized to not allow a frac-ball or other objects from a lower zone to create a seal on the distal end on cap.

Figure 5:
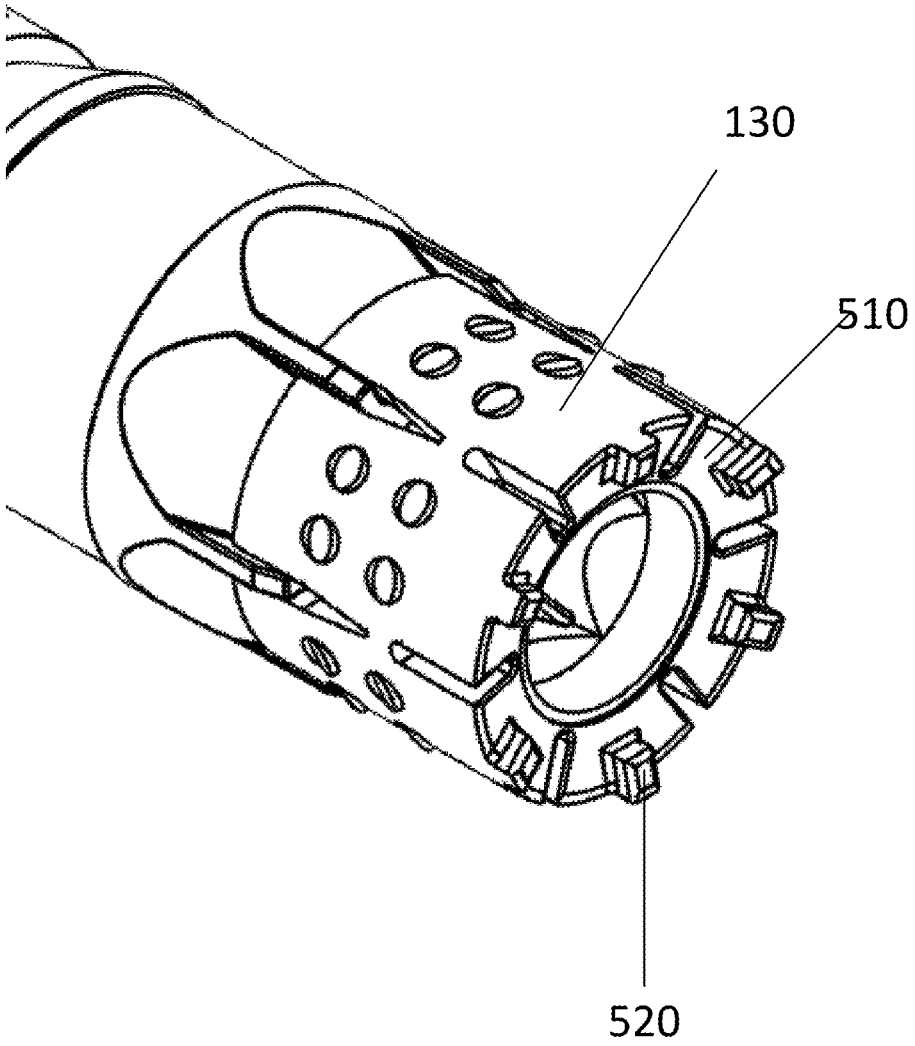
FIG. 5 depicts a detailed view of lower slips, according to an embodiment.

FIG. 5 depicts a detailed view of lower slips 130, according to an embodiment. Elements depicted in FIG. 5 may be described above, and for the sake of brevity a further description of these elements is omitted.

As depicted in FIG. 5, a distal end 510 of lower slips 130 may include a plurality anti-rotation projections 510. Projections 510 may have an outer diameter that is the same as that of lower slips 130, and extend inward towards a central axis of lower slips 130. The anti-rotation projections 510 may be a castling series of projections, which increase the length of lower slips 130..

Figure 6:
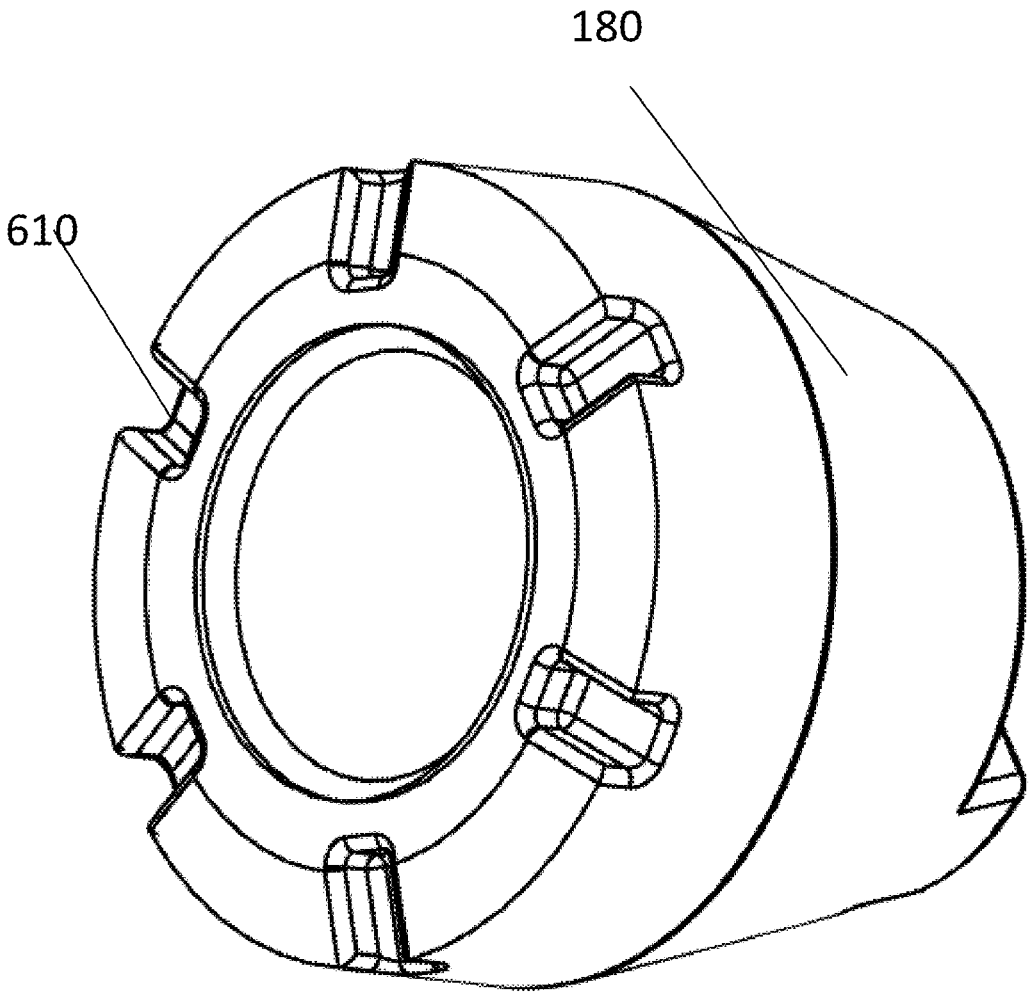
FIG. 6 depicts a detailed view of a cap, according to an embodiment.

FIG. 6 depicts a detailed view of cap 180, according to an embodiment. Elements depicted in FIG. 5 may be described above, and for the sake of brevity a further description of these elements is omitted.

As depicted in FIG. 6, an inner surface of cap 180 may include a plurality of grooves, depressions, etc. 610. The depressions may extend inward from an outer circumference of cap 180 towards a central axis of cap 180.

Projections 510 may be configured to be interfaced with grooves 610 positioned on cap 180. Responsive to the projections 510 being interfaced with the grooves 610 positioned on cap 180, lower slips 130 may move longitudinally relative to cap 180 but may be restricted from rotating relative to cap 180.

In alternative embodiments, projections 510 may be positioned on cap 180, while lower slips 130 include depressions.

Reference throughout this specification to "one embodiment", "an embodiment", "one example" or "an example" means that a particular feature, structure or characteristic described in connection with the embodiment or example is included in at least one embodiment of the present invention. Thus, appearances of the phrases "in one embodiment", "in an embodiment", "one example" or "an example" in various places throughout this specification are not necessarily all referring to the same embodiment or example. Furthermore, the particular features, structures or characteristics may be combined in any suitable combinations and/or sub-combinations in one or more embodiments or examples. In addition, it is appreciated that the figures provided herewith are for explanation purposes to persons ordinarily skilled in the art and that the drawings are not necessarily drawn to scale.

Although the present technology has been described in detail for the purpose of illustration based on what is currently considered to be the most practical and preferred implementations, it is to be understood that such detail is solely for that purpose and that the technology is not limited to the disclosed implementations, but, on the contrary, is intended to cover modifications and equivalent arrangements that are within the spirit and scope of the appended claims. For example, it is to be understood that the present technology contemplates that, to the extent possible, one or more features of any implementation can be combined with one or more features of any other implementation.

What is claimed is:

1. A frac plug comprising:

a mandrel;

lower slips with a first thread, the first thread being configured to couple the lower slips with the mandrel, wherein the first thread is configured to restrict the longitudinal movement of the lower slips before setting the frac plug, and upon setting, the first thread is configured to permit the longitudinal movement of the lower slips after activation of the first thread:

a lower cone with a fin and a ramp, wherein the fin has a first portion and a second portion, wherein a first angle of the first portion is different than a second angle of the second portion.

2. The frac plug of claim 1, wherein the lower slips include an inner surface with an inner surface angle, wherein the first thread is a breakable thread.

3. A frac plug comprising:

a mandrel;

lower slips with a first thread, the first thread being configured to couple the lower slips with the mandrel, wherein the first thread is configured to restrict the longitudinal movement of the lower slips before setting the frac plug, and upon setting, the first thread is configured to permit the longitudinal movement of the lower slips after activation of the first thread, the lower slips including an inner surface with an inner surface angle, wherein the first thread is a breakable thread;

a lower cone with a fin and a ramp with a ramp angle, the ramp angle being substantially equal to the inner surface angle of the lower slips;

a cap positioned adjacent to the lower slips, a first surface of the cap including grooves;

projections positioned on a distal surface of the lower slips;

the projections being configured to interface with the grooves to allow relative linear movement of the cap and lower slips while restricting relative rotational movement of the cap and lower slips.

4. The frac plug of claim 1, further comprising:

a first channel having a first width and a second width the first width being substantially equal to that of a fin of the lower slips, wherein the second width changes from a proximal end of the first channel to a second end of the first channel, wherein the fin and the channel include planar sidewalls that extend in parallel to each other.

5. The frac plug of claim 4, wherein the fin includes a tapered distal end that gradually reduces a height of the fin while the width of the fin remains constant.

6. The frac plug of claim 1, further comprising:

a flapper within a weak point assembly positioned across an inner diameter of the mandrel, the weak point assembly being configured to break based on a pressure applied against the flapper.

* * * * *